US005085194A

United States Patent [19]

Kuroda et al.

[11] Patent Number: 5,085,194

[45] Date of Patent: Feb. 4, 1992

[54] METHOD OF DETECTING ABNORMALITY IN AN EVAPORATIVE FUEL-PURGING SYSTEM FOR INTERNAL COMBUSTION ENGINES

[75] Inventors: Shigetaka Kuroda; Hisashi Igarashi; Hidekazu Kano; Takeshi Suzuki, all of Wako, Japan

[73] Assignee: Honda Giken Kogyo K.K., Tokyo, Japan

[21] Appl. No.: 681,937

[22] Filed: Apr. 8, 1991

[30] Foreign Application Priority Data

May 31, 1990 [JP] Japan ..... 2-142824
Aug. 6, 1990 [JP] Japan ..... 2-207914

[51] Int. Cl.[5] ..... F02D 41/22; F02M 25/08

[52] U.S. Cl. ..... 123/479; 123/198; 123/489; 123/520

[58] Field of Search ..... 123/198 D, 440, 479, 123/489, 518–520

[56] References Cited

U.S. PATENT DOCUMENTS 4,949,695 8/1990 Uranishi et al. ..... 123/520
4,962,744 10/1990 Uranishi et al. ..... 123/520

FOREIGN PATENT DOCUMENTS 186955 8/1988 Japan .
189639 8/1988 Japan .

*Primary Examiner*—Tony M. Argenbright
*Attorney, Agent, or Firm*—Arthur L. Lessler

[57] ABSTRACT

A method of detecting abnormality in an evaporative fuel-purging system (evaporative emission control system) for an internal combustion engine comprises the steps of: (1) determining whether or not the engine is in a predetermined operating condition after completion of warming-up of the engine, (2) temporarily inhibiting purging of evaporative fuel into an intake passage when it is determined that the engine is in the predetermined operating condition, (3) obtaining a first value based on a parameter reflecting an amount of evaporative fuel purged into the intake passage during the temporary inhibition of the purging of the evaporative fuel, (4) obtaining a second value based on the parameter during execution of the purging of the evaporative fuel carried out after the temporary inhibition of the purging of the evaporative fuel, (5) comparing the first value with the second value, and (6) determining whether or not there is abnormality in the evaporative fuel-purging system, based on a result of the comparison.

16 Claims, 12 Drawing Sheets

FUEL INJECTION VALVE
INTERNAL COMBUSTION ENGINE
THREE - WAY CATARYST
ELECTRICAL LOAD SW
AIR-CONDITIONER SW
BRAKE SW
V
CYL
Ne
Tw
PBA
θTH
O2
INPUT CIRCUIT
CPU
MEMORY MEANS
OUTPUT CIRCUIT
ECU
1
2
3
3'
4
5
5a
5b
5c
5d
6
7
8
9
10
11
12
13
14
15
16
17
18
18'
18'a
18"
19
19a
20
21
22
23
24

METHOD OF DETECTING ABNORMALITY IN AN EVAPORATIVE FUEL-PURGING SYSTEM FOR INTERNAL COMBUSTION ENGINES

BACKGROUND OF THE INVENTION

This invention relates to a method of detecting abnormality in an evaporative fuel-purging system for an internal combustion engines.

An evaporative fuel-purging system, which is also called "evaporative emission control system", comprises a canister for temporarily storing evaporative fuel from a fuel tank, and purging control means for controlling purging of the evaporative fuel into the intake system of the engine when the engine is operating.

An evaporative fuel-purging system of this kind can undergo deterioration of the canister, disengagement of joints of the piping, etc., which results in improper purging of the evaporative fuel. Therefore, it is waited for to provide a method of detecting such failure.

Conventionally, a fuel supply control system for an internal combustion engine is known, e.g. from Japanese Provisional Patent Publication (Kokai) No. 63-186955, in which an air-fuel ratio feedback control correction coefficient is determined based on an air-fuel ratio signal from an air-fuel ratio sensor for controlling an amount of fuel supplied to the engine, and at the same time evaporative fuel from the fuel tank is purged into the intake passage. In this known fuel supply control system, the evaporative fuel is supplied to the intake passage at a location at which negative pressure prevails when a throttle valve in the intake passage is opened by a predetermined degree or more from a fully closed position thereof. Therefore, an amount of evaporative fuel supplied to the intake passage assumes a value substantially equal to 0 when the engine is idling, and the maximum value when the engine is in a low load condition. Based on the recognition of this phenomenon, a system has been proposed in the above-mentioned publication, which is adapted to calculate the difference between a central value of the above-mentioned correction coefficient obtained during idling of the engine and a central value of same obtained when the engine is in a low load condition, and estimate from the difference the concentration of evaporative fuel corresponding to an amount of evaporative fuel which is actually purged into the intake passage.

Therefore, it is possible to detect whether or not there is failure in the evaporative fuel-purging system by utilizing the above-mentioned manner of estimating the concentration of evaporative fuel, i.e. by comparing an estimated actual value of the concentration of evaporative fuel, i.e. the amount of evaporative fuel actually purged into the intake passage with a reference value of the amount of evaporative fuel purged into the intake passage, which should be obtained when the evaporative fuel-purging system is normally functioning under the same conditions as the estimated actual value is obtained.

However, when evaporative fuel is purged into the intake passage, generally the amount of evaporative fuel purged largely fluctuates depending on a change in the magnitude of load on the engine, particularly a change in the degree of opening of the throttle valve, and accordingly, the air-fuel ratio correction coefficient largely varies under the influence of fluctuations in the amount of evaporative fuel purged, i.e., depending on the load on the engine. Particularly when the engine is in a low load condition, the variation in the correction coefficient is large.

Therefore, in the above proposed system, the central value of the correction coefficient obtained when the engine is in a low load condition fluctuates with a change in the magnitude of load on the engine, so that it is difficult to obtain a stable and accurate central value. This in turn makes it difficult to obtain an accurate estimated value, and accordingly the use of an inaccurate estimated value makes it impossible to accurately detect failure in the evaporative fuel-purging system.

Further, the estimated value of the amount of evaporative fuel purged into the intake system varies depending on an amount of evaporative fuel actually stored in the canister. More specifically, if the amount of evaporative fuel stored in the canister is small, the amount of evaporative fuel purged under a low load condition of the engine is small. Therefore, the amount of change in the correction coefficient between the idling and the low load condition of the engine is small in such a case. This may bring about an erroneous detection of failure in the evaporative fuel-purging system. This also makes it difficult to accurately detect failure of the evaporative fuel-purging system by utilizing the manner of estimating the concentration of evaporative fuel disclosed in the aforementioned publication.

SUMMARY OF THE INVENTION

It is the object of the invention to provide a method of detecting abnormality in an evaporative fuel-purging system of an internal combustion which enables to accurately detect the abnormality.

To attain the above object, the present invention provides a method of detecting abnormality in an evaporative fuel-purging system for an internal combustion engine having a fuel tank, and an intake passage, the evaporative fuel-purging system having a canister for adsorbing evaporative fuel from the fuel tank, and a purging passage through which the evaporative fuel is purged from the canister into the intake passage, the engine having a sensor for detecting a parameter reflecting an amount of the evaporative fuel purged into the intake passage.

The method according to the invention is characterized by comprising the steps of:

(1) determining whether or not the engine is in a predetermined operating condition after completion of warming-up of the engine;

(2) temporarily inhibiting the purging of the evaporative fuel into the intake passage when it is determined that the engine is in the predetermined operating condition;

(3) obtaining a first value based on the parameter during the temporary inhibition of the purging of the evaporative fuel;

(4) obtaining a second value based on the parameter during execution of the purging of the evaporative fuel carried out after the temporary inhibition of the purging of the evaporative fuel;

(5) comparing the first value with the second value; and (6) determining whether or not there is abnormality in the evaporative fuel-purging system, based on a result of the comparison.

In a first preferred form of the invention, the engine has an exhaust passage, the sensor being an air-fuel ratio sensor arranged in the exhaust passage for detecting an air-fuel ratio of a mixture supplied to the engine as the parameter, the first and second values being values of an air-fuel ratio correction coefficient determined based on the detected air-fuel ratio for controlling an amount of fuel supplied to the engine.

Preferably, the step (6) comprises determining that there is abnormality in the evaporative fuel-purging system when the second value of the air-fuel ratio correction coefficient is larger than a predetermined reference value obtained by subtracting a correction value corresponding to an amount of the evaporative fuel to be purged into the intake passage from the first value of the air-fuel ratio correction coefficient.

More preferably, it is determined that there is abnormality in the evaporative fuel-purging system when the second value has continually been larger than the predetermined reference value over a first predetermined time period.

Preferably, the predetermined operating condition is a condition in which a temperature of the engine is not lower than a predetermined value, and at the same time a vehicle on which the engine is installed is cruising.

More preferably, the first value of the air-fuel ratio correction coefficient is calculated by averaging values of the air-fuel ratio correction coefficient obtained when the engine is in the predetermined operating condition, over a second predetermined time period.

Further preferably, the inhibition of the purging of the evaporative fuel into the intake passage is continued until calculation of the first value of the air-fuel ratio correction coefficient is completed after the start of the engine carried out when the temperature of the engine is lower than the predetermined value.

Preferably, the purging of the evaporative fuel into the intake passage is carried out irrespective of operating conditions of the engine, when a third predetermined time period has elapsed after completion of the warming-up of the engine.

In a second preferred form of the invention, the sensor is an inflammable gas sensor arranged in the purging passage for detecting concentration of the evaporative fuel as the parameter, the first and second values based on the parameter being values of output from the inflammable gas sensor.

Preferably, the step (6) comprises determining that there is abnormality in the evaporative fuel-purging system when the second value of the output from the inflammable gas sensor is not larger than a predetermined reference value obtained by adding a correction value corresponding to an amount of the evaporative fuel to be purged into the intake passage to the first value of the output from the inflammable gas sensor.

More preferably, it is determined that there is abnormality in the evaporative fuel-purging system when the second value has continually been not larger than the predetermined reference value over a first predetermined time period.

Preferably, the predetermined operating condition is a condition in which a temperature of the engine is not lower than a predetermined value, and at the same time a vehicle on which the engine is installed is cruising.

More preferably, the first value of the output from the inflammable gas sensor is calculated by averaging values of the output from the inflammable gas sensor obtained when the engine is in the predetermined operating condition, over a second predetermined time period.

Further preferably, the inhibition of the purging of the evaporative fuel into the intake passage is continued until calculation of the first value of the output from the inflammable gas sensor is completed after the start of the engine carried out when the temperature of the engine is lower than the predetermined value.

Preferably, the purging of the evaporative fuel into the intake passage is carried out irrespective of operating conditions of the engine, when a third predetermined time period has elapsed after completion of the warming-up of the engine.

Alternatively, the engine has a throttle valve arranged in the intake passage, and the predetermined operating condition is a condition in which a temperature of the engine is not lower than a predetermined value, and at the same time the opening of the throttle valve is not smaller than a predetermined value.

The above and other objects, features, and advantages of the invention will become more apparent from the ensuing detailed description taken in conjunction with the accompanying drawings.

BRIEF DESCRIPTION OF THE INVENTION

FIG. 1 is a block diagram illustrating the whole arrangement of a fuel supply control system including an evaporative fuel-purging system to which is applied a method according to a first embodiment of the invention;

FIGS. 2*a* and 2*b* are a flowchart of a program for detecting failure in the evaporative fuel-purging system according to the first embodiment;

FIG. 3 is a view showing a $T_W-t_{PC}$ table;

FIGS. 4*a* and 4*b* are a flowchart of a subroutine SUB 1 executed at a step 112 appearing in FIG. 2;

Figure 6:
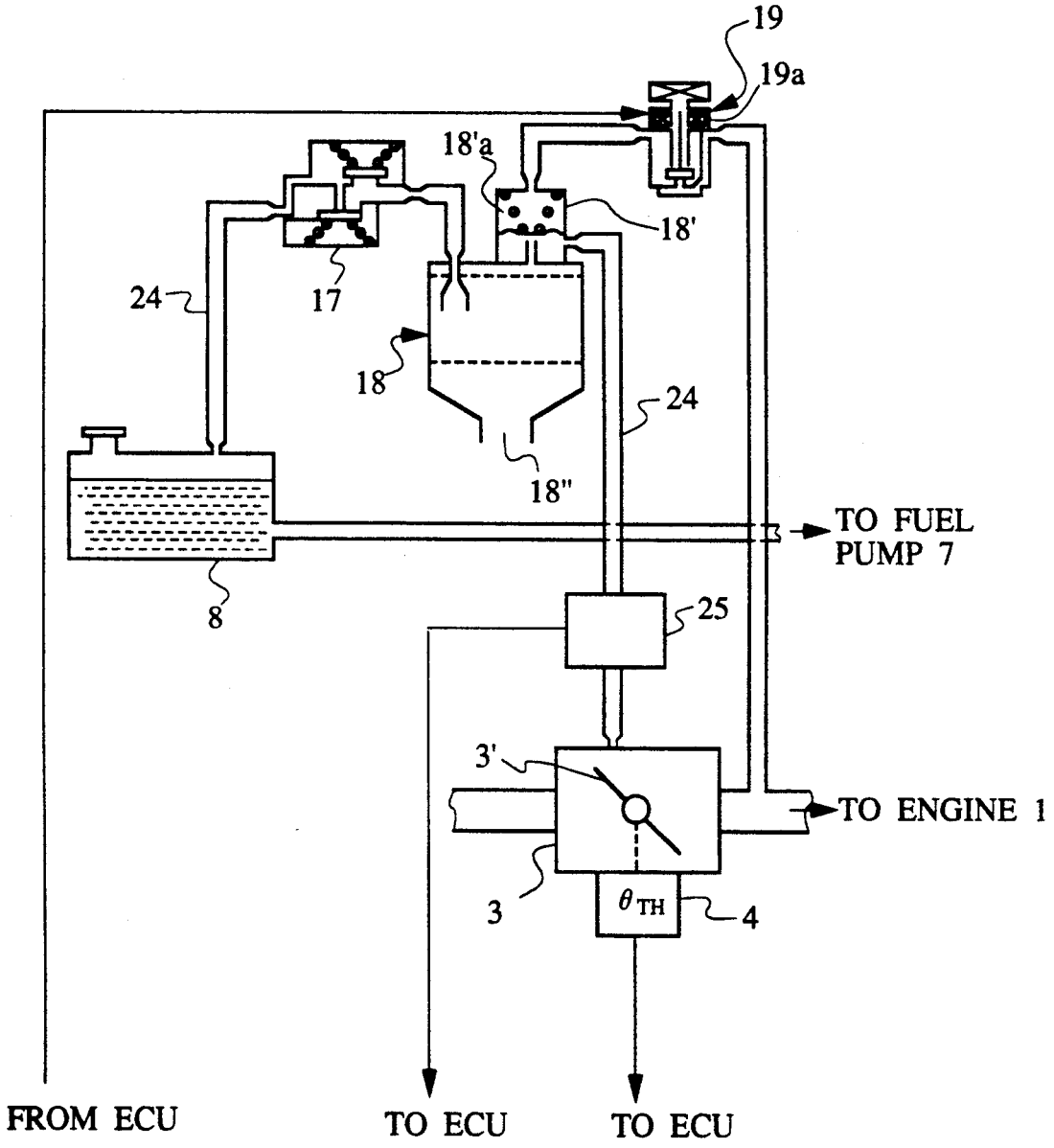
FIG. 6 is a fragmentary block diagram illustrating part of the arrangement of a fuel supply control system including an evaporative fuel-purging system to which is applied a method according to a second embodiment of the invention.
Figure 7A:
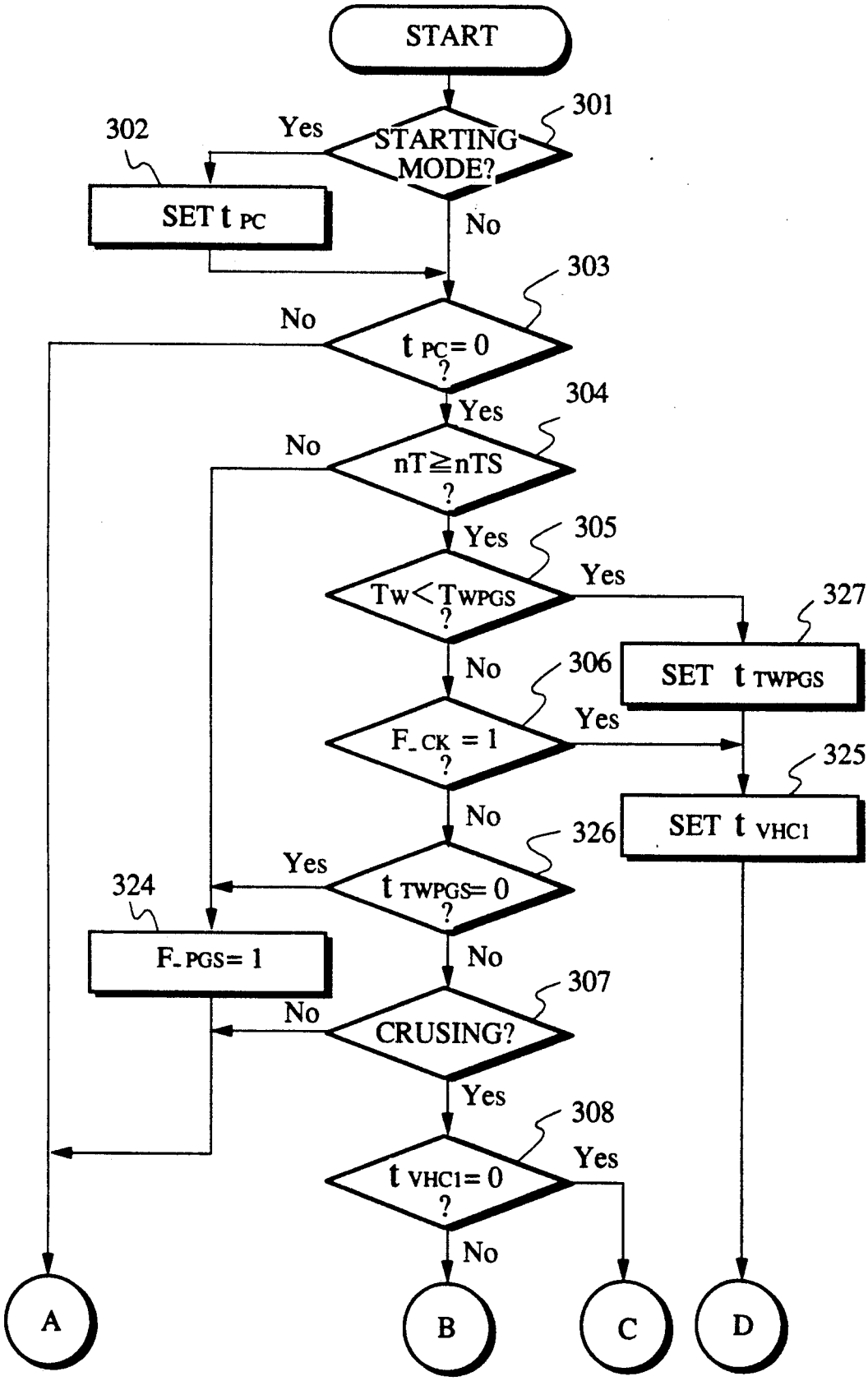
Figure 7B:
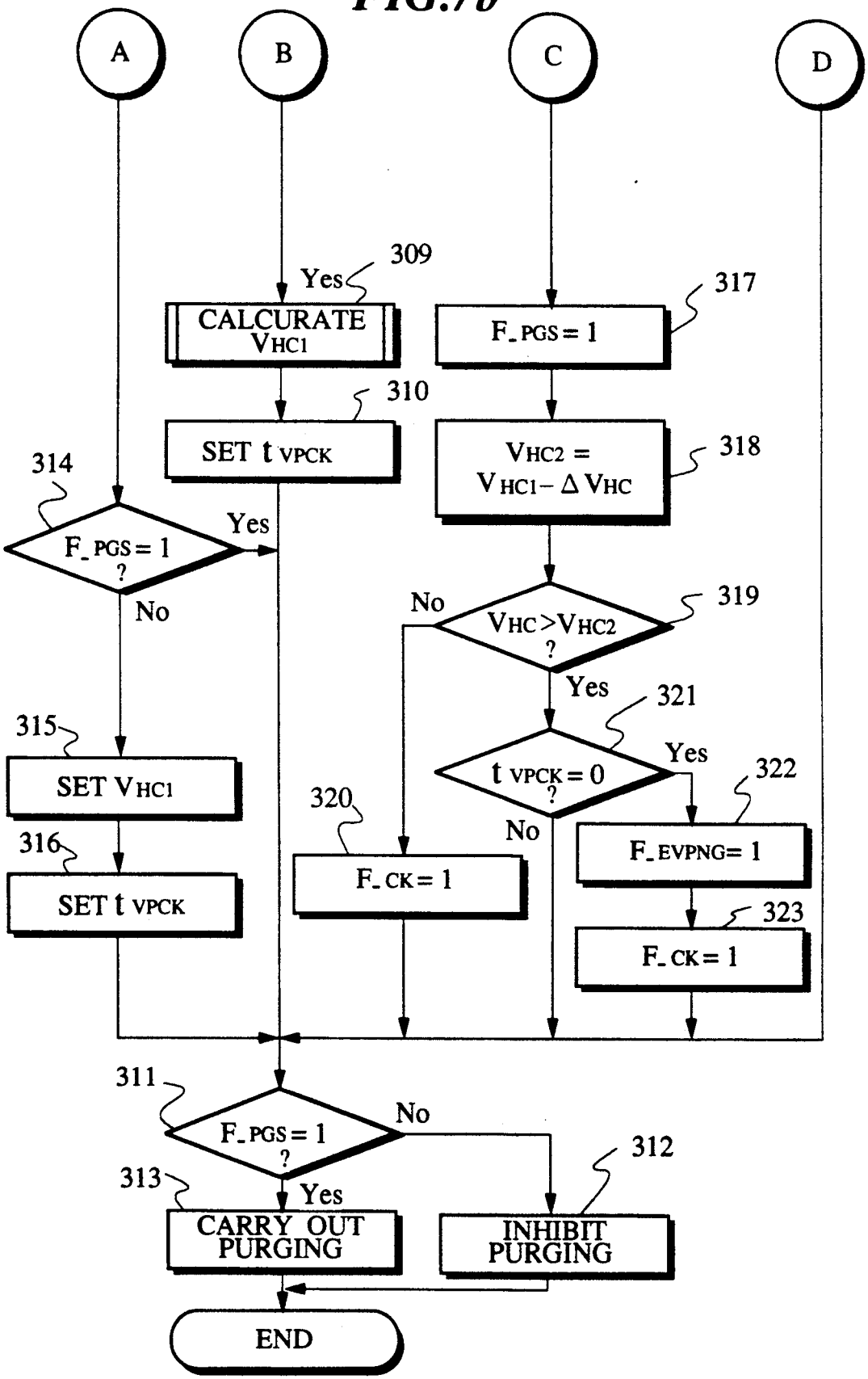
Figure 8:
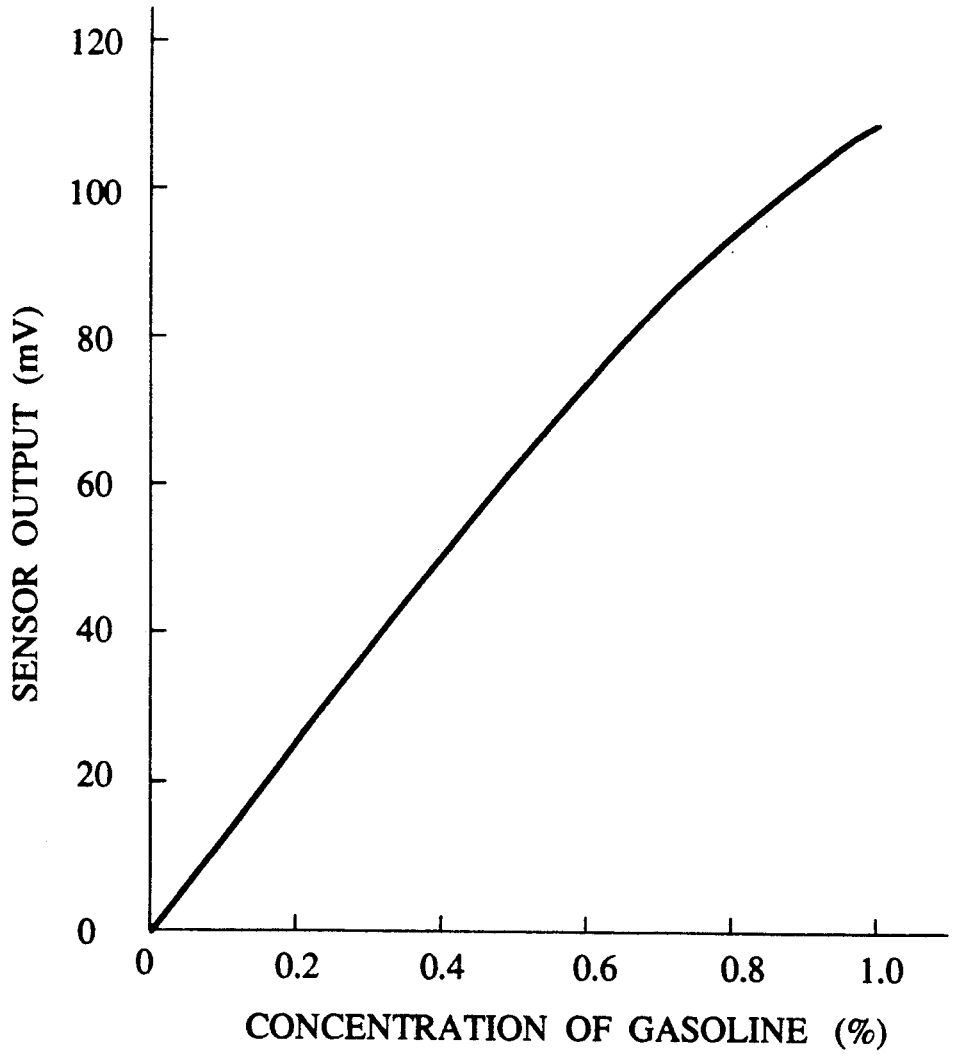
Figure 9:
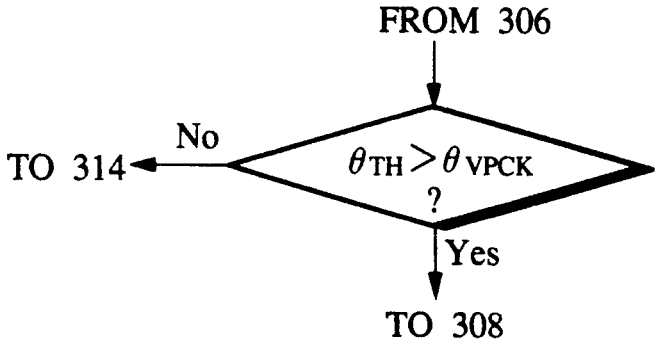

FIGS. 7*a* and 7*b* are a flowchart of a program for detecting failure in the evaporative fuel-purging system according to the second embodiment;

FIG. 8 is a graph showing an output characteristic of an inflammable gas sensor appearing in FIG. 6; and FIG. 9 is a view showing a variation of the program of FIG. 7.

DETAILED DESCRIPTION

The invention will now be described in detail with reference to the drawings showing embodiments thereof.

Figure 1:
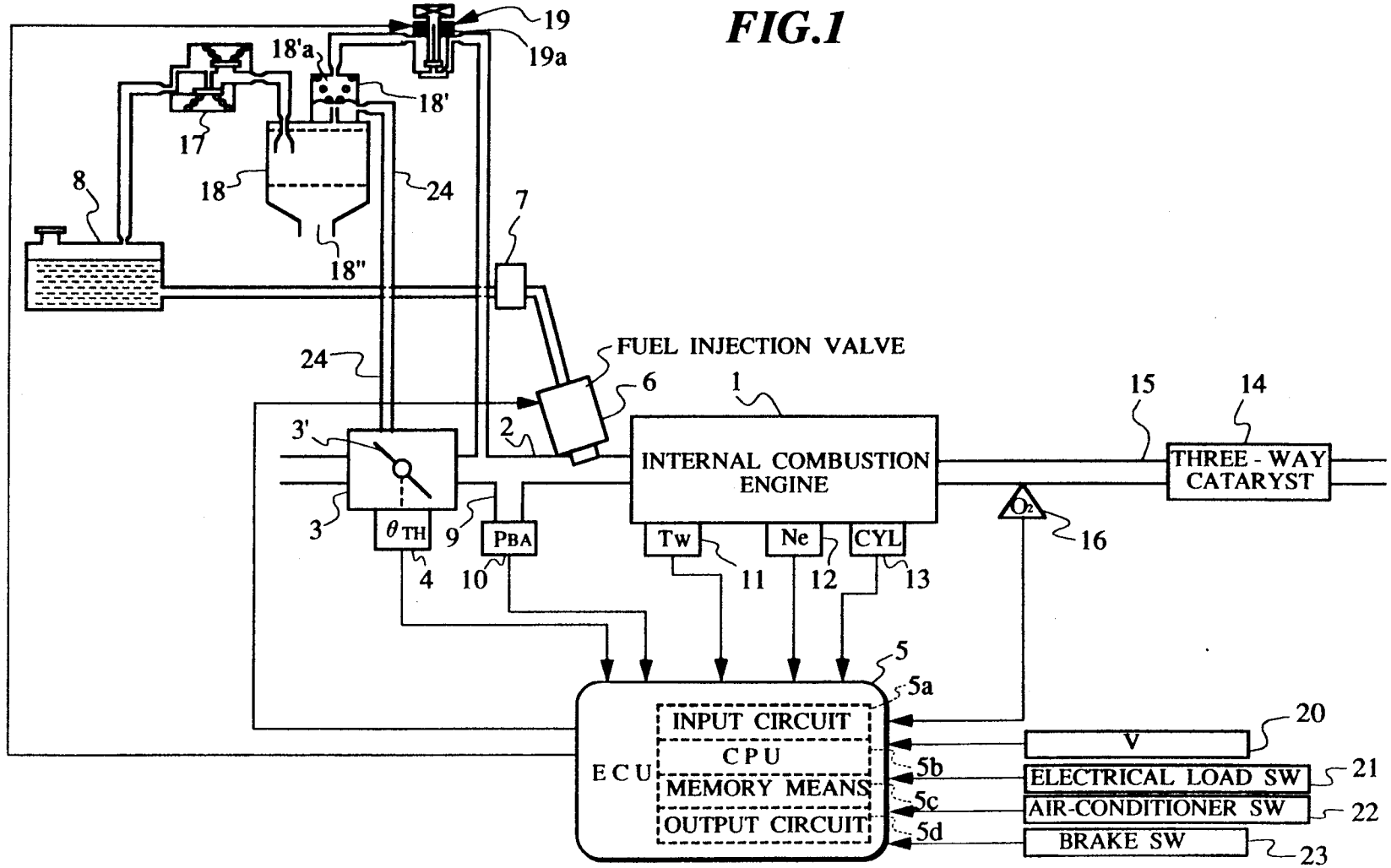

Referring first to FIG. 1, there is illustrated the whole arrangement of a fuel supply control system of an internal combustion engine including an evaporative fuel-purging system to which is applied a method of detecting abnormality in this system according a first embodiment of the invention. In the figure, reference numeral 1 designates an internal combustion engine for automotive vehicles. The engine is a four-cylinder type, for instance. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe at locations intermediate between the cylinder block of the engine 1 and the throttle valve 3' and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure ($P_{BA}$) sensor 10 is provided in communication with the interior of the intake pipe 2 via a conduit 9 at a location immediately downstream of the throttle valve 3' for supplying an electric signal indicative of the sensed absolute pressure within the intake pipe 2 to the ECU 5.

An engine coolant temperature ($T_W$) sensor 11, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 12 and a cylinder-discriminating (CYL) sensor 13 are arranged in facing relation to a camshaft or a crankshaft of the engine 1, neither of which is shown. The engine rotational speed sensor 12 generates a pulse as a TDC signal pulse at each of predetermined crank angles whenever the crankshaft rotates through 180 degrees, while the cylinder-discriminating sensor 13 generates a pulse at a predetermined crank angle of a particular cylinder of the engine, both of the pulses being supplied to the ECU 5.

A three-way catalyst 14 is arranged within an exhaust pipe 15 connected to the cylinder block of the engine 1 for purifying noxious components such as HC, CO, and NOx. An $O_2$ sensor 16 as an exhaust gas ingredient concentration sensor is mounted in the exhaust pipe 15 at a location between the engine 1 and the three-way catalyst 14, for sensing the concentration of oxygen present in exhaust gases emitted from the engine 1 and supplying an electric signal indicative of a detection value $V_{O2}$ to the ECU 5.

A conduit line (purging passage) 24 extends from an upper space in the fuel tank 8 and opens into the intake pipe 2 (into the throttle body 3 in the illustrated embodiment) at a location in the vicinity of a position of the throttle valve 3' of the throttle body 3 assumed when the throttle valve is fully closed. Arranged across the conduit line 24 is an evaporative fuel-purging system (evaporative emission control system) comprising a two-way valve 17, a canister 18 having a purge cut valve 18', and a purge control valve 19 which has a solenoid 19a for driving same and is connected to both the atmosphere and the interior of the intake pipe. The solenoid 19a of the purge control valve 19 is connected to the ECU 5 and controlled by a signal supplied therefrom, such that the control valve 19 selectively supplies negative pressure or atmospheric pressure to a negative pressure chamber 18'a of the purge cut valve 18' defined by a diaphragm to thereby open and close the purge cut valve 18'. More specifically, evaporative fuel or gas (hereinafter merely referred to as "evaporative fuel") generated within the fuel tank 8 forcibly opens a positive pressure valve of the two-way valve 17 when the pressure of the evaporative fuel reaches a predetermined level, to flow through the valve 17 into the canister 18, where the evaporative fuel is adsorbed by an adsorbent in the canister and thus stored therein.

In the meanwhile, when the solenoid 19a is energized by the control signal from the ECU 5, the purge control valve 19 supplies atmospheric pressure to the purge cut valve 18' to close same, whereas when the solenoid 19a is deenergized, the purge control valve 19 supplies negative pressure from the intake pipe 2 to the purge cut valve 18' to open same, whereby evaporative fuel temporarily stored in the canister 18 flows therefrom together with fresh air introduced through an outside air-introducing port 18", through the purging passage 24 and the throttle body 3 into the intake pipe 2 to be supplied to the cylinders. When the fuel tank 18 is cooled due to low ambient temperature etc. so that negative pressure increases within the fuel tank 8, a negative pressure valve of the two-way valve 17 is opened to return evaporative gas temporarily stored in the canister 18 into the fuel tank 8. In the above described manner, the evaporative fuel generated within the fuel tank 8 is prevented from being emitted into the atmosphere.

Even when the purge cut valve 18' is open as mentioned above, supply of evaporative fuel into the intake pipe 2 actually takes place only when the throttle valve 3' is opened by a predetermined degree or more from a fully closed position thereof, i.e. when the engine is in a low load condition, whereas almost no supply of evaporative fuel takes place when the throttle valve 3 is in the fully closed position, i.e., when the engine is idling.

Further connected to the ECU 5 are a vehicle speed sensor 20 for detecting the travel speed V of a vehicle on which the engine 1 is installed, an electrical load switch sensor 21 for detecting on-off states of operating switches of electrical devices installed on the vehicle, which act as loads on the engine, such as headlights, an air-conditioner switch sensor 22 for detecting on-off state of an operating switch of an air-conditioner installed on the vehicle, and a brake switch sensor 23 for detecting on-off state of a brake switch, which turns on when the brake is actuated. Output signals from these sensors are supplied to the ECU 5.

The ECU 5 comprises an input circuit 5a having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5b which carries out failure-detecting programs, referred to hereinafter, etc., memory means 5c storing a $T_W-t_{PC}$ table and a Ti map, referred to hereinafter, and various operational programs which are executed in the CPU 5b and for storing results of calculations therefrom, etc., and an output circuit 5d which outputs driving signals to the fuel injection valves 6 and the purge control valve 19.

The CPU 5b operates in response to the above-mentioned signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period $T_{OUT}$ over which the fuel injection valves 6 are to be opened, by the use of the following equation in synchronism with inputting the TDC signal pulses to the ECU 5.

$$T_{OUT}=T_i\times K_1\times K_{O2}+K_2 \quad (1)$$

where $T_i$ represents a basic value of the fuel injection period $T_{OUT}$ of the fuel injection valves 6, which is read from a Ti map set in accordance with the engine rotational speed Ne and the intake pipe absolute pressure $P_{BA}$.

$K_{O2}$ represents an air-fuel ratio feedback correction coefficient whose value is determined in response to the oxygen concentration in the exhaust gases detected by the $O_2$ sensor 16, during feedback control, while it is set to respective predetermined appropriate values while the engine is in predetermined operating regions (the open-loop control regions) other than the feedback control region. The correction coefficient $K_{O2}$ is calculated in the following manner: The output level $V_{O2}$ of the $O_2$ sensor 16 is compared with a predetermined reference value. When the output level $V_{O2}$ is inverted with respect to the predetermined reference value, the correction coefficient $K_{O2}$ is calculated by a known proportional control method by addition of a proportional term (P-term) to the $K_{O2}$ value, whereas when the former remains uninverted, it is calculated by a known integral control method by addition of an integral term (I-term) to the $K_{O2}$ value. The manner of calculation of the correction coefficient $K_{O2}$ is disclosed in Japanese Provisional Patent Publications (Kokai) Nos. 63-137633 and 63-189639, etc.

$K_1$ and $K_2$ represent other correction coefficients and correction variables, respectively, which are calculated based on various engine parameter signals to such values as to optimize charateristics of the engine such as fuel consumption and accelerability depending on operating conditions of the engine.

The CPU 5b supplies through the output circuit 5d, the fuel injection valves 6 with driving signals corresponding to the calculated fuel injection period $T_{OUT}$ determined as above, over which the fuel injection valves 6 are opened.

Figure 2A:
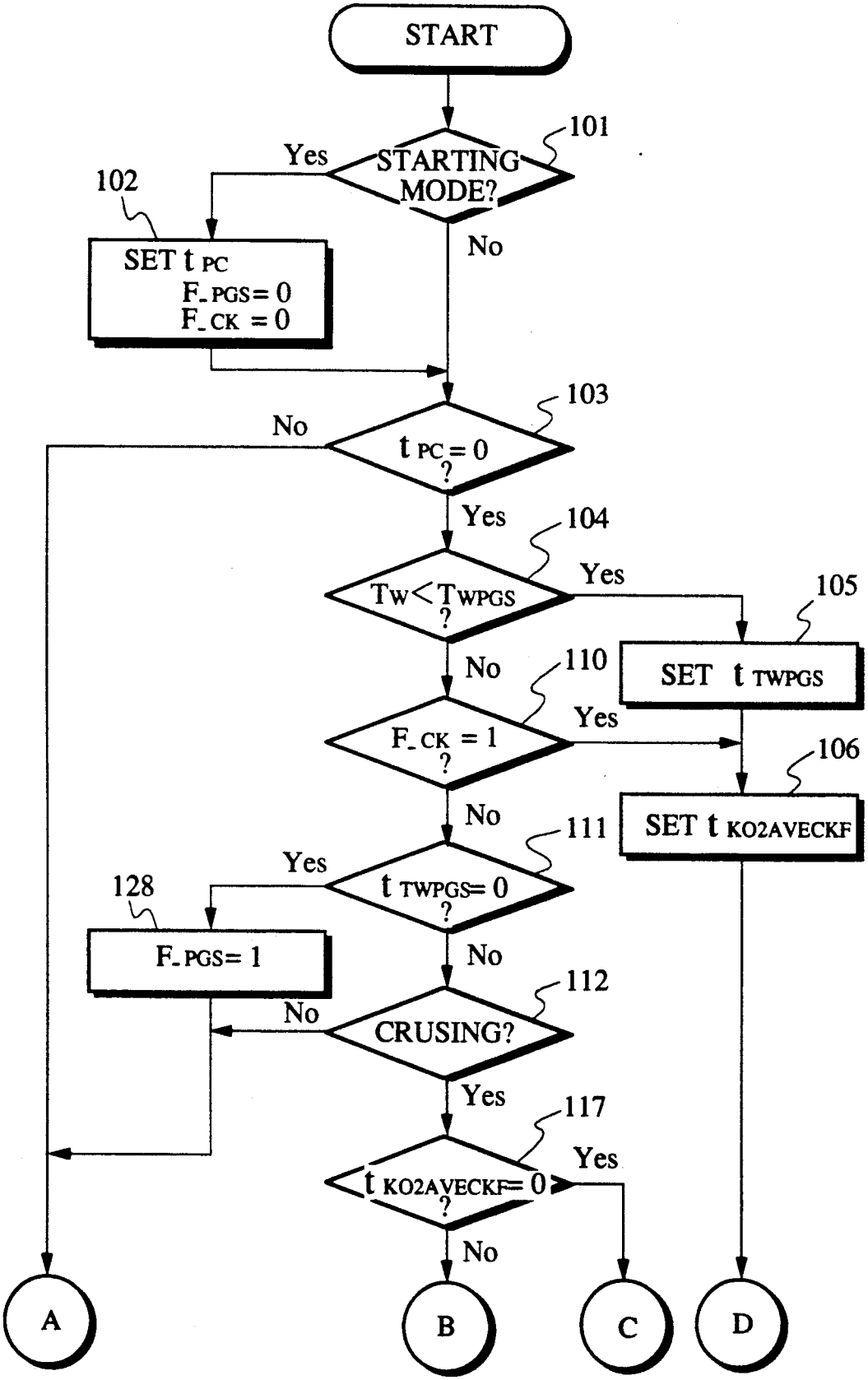
Figure 2B:
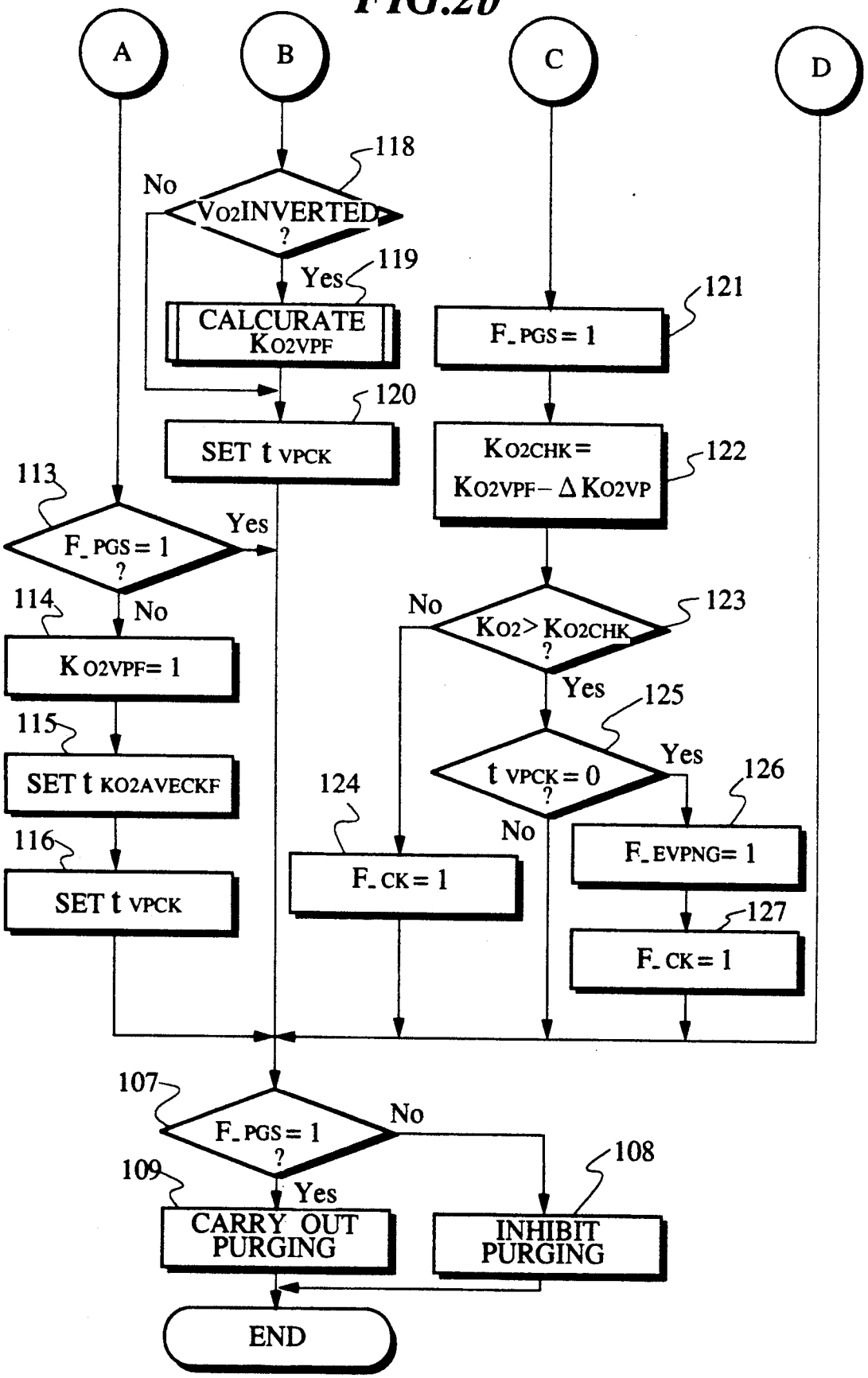

FIG. 2 shows a program for detecting failure in the evaporative fuel-purging system according to the method of a first embodiment of the invention. This program is executed by the CPU 5b whenever a TDC signal pulse is supplied to the ECU 5.

Figure 3:
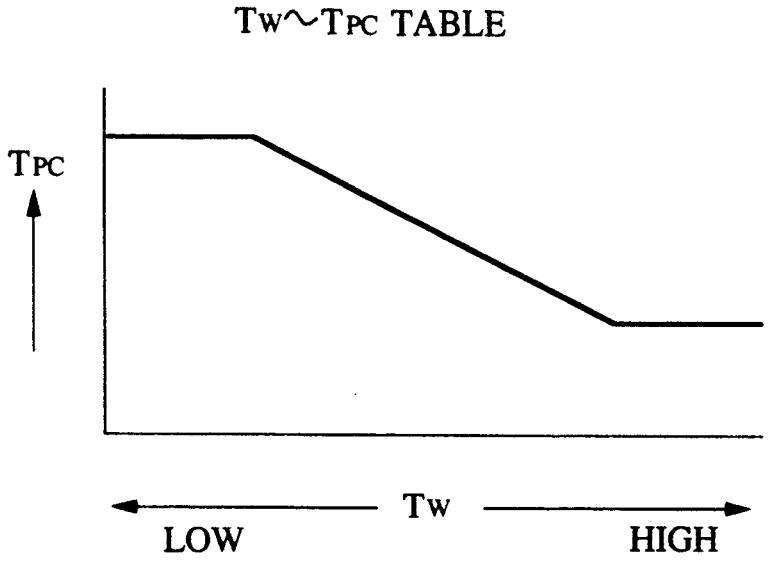

First at a step 101, it is determined whether or not the engine 1 is in a starting mode. If the answer to this question is affirmative (Yes), a $t_{PC}$ timer formed of a down counter, which measures time elapsed after the starting mode is completed, is set to a predetermined time period $t_{PC}$, a purge execution flag $F_{-PGS}$ (which indicates when assuming a value of 1 that purging of evaporative fuel into the intake pipe 2 should be carried out and when assuming a value of 0 that purging of same should be stopped), referred to hereinafter, is set to 0, and a system check-over flag $F_{-CK}$ (which indicates when assuming a value of 1 that checking of abnormality in the evaporative fuel-purging system is finished and when assuming a value of 0 that checking of same is not finished), referred to hereinafter, is set to 0, at a step 102. The predetermined time period $t_{PC}$ is set based on the $T_W-t_{PC}$ table shown in FIG. 3, the $t_{PC}$ timer value decreasing with a rise in the engine coolant temperature $T_W$.

On the other hand, if the answer to the question of the step 101 is negative (No), it is determined at a step 103 whether or not the count value of the $t_{PC}$ timer is equal to 0. If the answer to this question is negative (No), the program proceeds to a step 113, whereas if the answer is affirmative (Yes), i.e. if the predetermined time period $t_{PC}$ has elapsed after the engine 1 changed from the starting mode to a normal operation mode, the program proceeds to a step 104.

At the step 104, it is determined whether or not the engine coolant temperature $T_W$ is lower than a predetermined value $T_{WPGS}$ (e.g. 50° C.). The predetermined value $T_{WPGS}$ may consist of two values: a higher value to be used when the engine coolant temperature $T_W$ rises to the predetermined value $T_{WPGS}$ and a lower value to be used when the engine coolant temperature $T_W$ falls to the predetermined value $T_{WPGS}$.

If the answer to the question of the step 104 is affirmative (Yes), i.e. if the engine coolant temperature is lower than the predetermined value $T_{WPGS}$, a $t_{TWPGS}$ timer formed of a down counter, which measures time elapsed after the engine coolant temperature $T_W$ reached the predetermined value $T_{WPGS}$, is set to a predetermined time period $t_{TWPGS}$ (e.g. 15 minutes) at a step 105, and a $t_{KO2AVECKF}$ timer formed of a down counter, which measures time elapsed after the vehicle reached a predetermined cruising condition, is set to a predetermined time period $t_{KO2AVECKF}$ (e.g. 5 seconds) at a step 106, followed by the program proceeding to a step 107.

At the step 107, it is determined whether or not the flag $F_{-PGS}$ is equal to 1. If the answer to this question is negative (No), i.e. if purging of evaporative fuel into the intake pipe 2 should be stopped, the solenoid 19a of the purge control valve 19 is energized to close the purge cut valve 18' and accordingly stop purging of evaporative fuel. On the other hand, if the answer to the question of the step 107 is affirmative (Yes), i.e. if purging of evaporative fuel should be carried out, the solenoid 19a of the purge control valve 19 is deenergized to open the purge cut valve 18' and accordingly carry out purging at a step 109. After execution of the step 108 or 109, the present program is terminated.

On the other hand, if the answer to the question of the step 104 is negative (No), it is determined at a step 110 whether or not the system check-over flag $F_{-CK}$ is equal to 1. If the answer to this question is affirmative (Yes), checking of the evaporative fuel-purging system is finished, the program proceeds to the step 106 without carrying out checking of the system abnormality to be carried out at steps 111 to 128, whereas if the answer is negative (No), the program proceeds to the step 111.

At the step 111, it is determined whether or not the count value of the $t_{TWPGS}$ timer is equal to 0. If the answer to this question is negative (No), i.e. if the predetermined time period $t_{TWPGS}$ has not elapsed yet after the engine coolant temperature $T_W$ became higher than the predetermined value $T_{WPGS}$, the program proceeds to a step 112, where it is determined whether or not the vehicle is in a cruising condition.

Figure 4A:
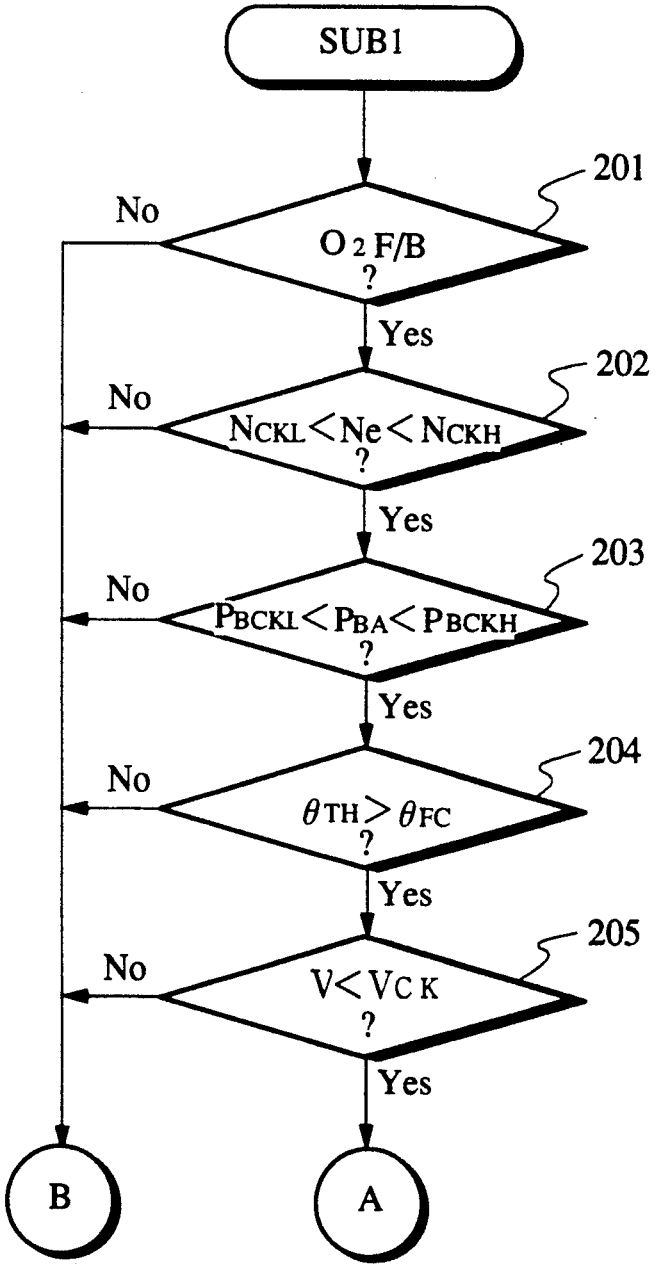
Figure 4B:
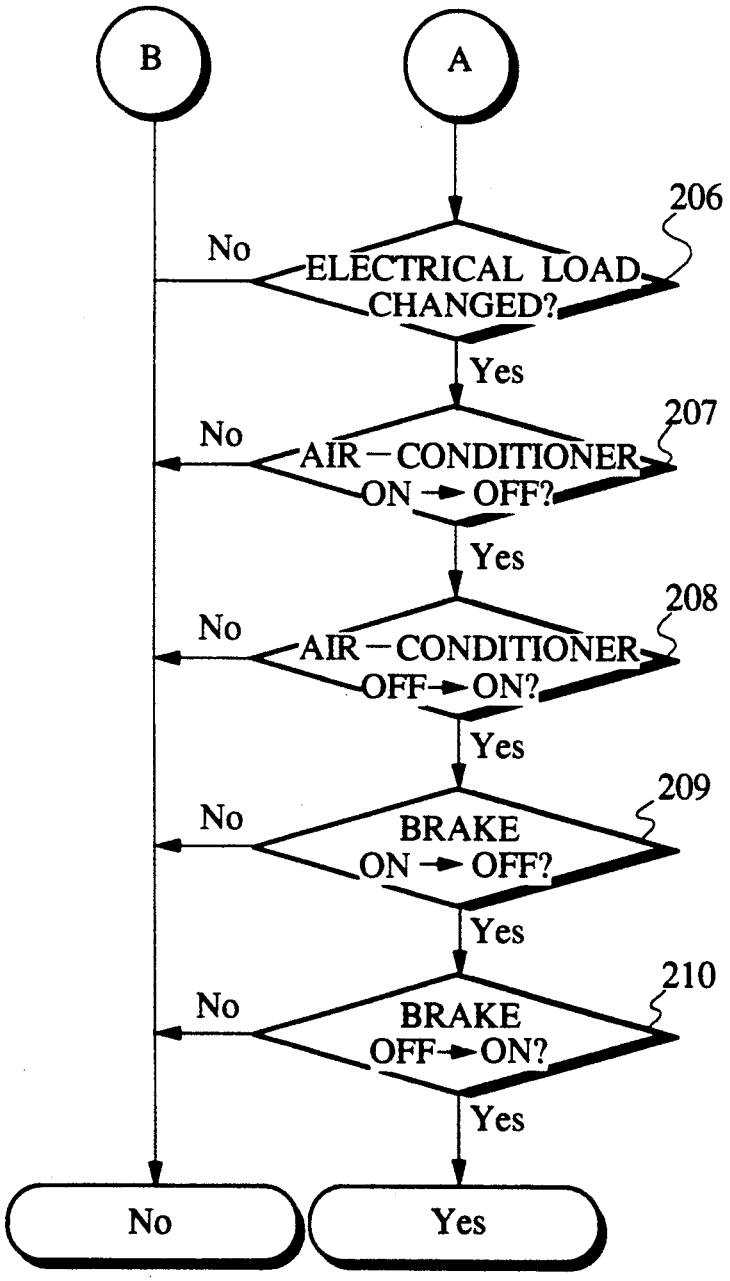

Details of processing at the step 112 will be described below with reference to a subroutine SUB 1 shown in FIG. 4.

At steps 201 to 210 the following determinations are carried out, respectively, as to: whether or not the air-fuel ratio feedback (F/B) control based on the output value of the $O_2$ sensor 16 is being carried out (step 201), whether or not the engine rotational speed Ne calculated based on the TDC signal pulses supplied from the Ne sensor 12 is within a range between a predetermined lower limit value $N_{CKL}$ (e.g. 2000 rpm) and a predetermined higher limit value $N_{CKH}$ (e.g. 4000 rpm) (step 202), whether or not the intake pipe absolute pressure $P_{BA}$ detected by the $P_{BA}$ sensor 10 is within a range between a predetermined lower limit value $P_{BCKL}$ (e.g. 310 mmHg) and a predetermined higher limit value $P_{BCKH}$ (e.g. 610 mmHg) (step 203), whether or not the throttle valve opening $\theta_{TH}$ detected by the $\theta_{TH}$ sensor 4 is larger than a value $\theta_{FC}$ corresponding to a substantially fully closed position of the throttle valve 3' (step 204), whether or not the travel speed V of the vehicle detected by the vehicle speed sensor 20 is higher than a predetermined value $V_{CK}$ (e.g. 8 km/h) (step 205), whether or not there has been a change in electrical load on the engine between the immediately preceding loop and the present loop, which is determined based on output from the electrical load switch sensor 21 (step 206), whether or not there has been a change from ON to OFF or OFF to ON of the air-conditioner between the immediately preceding loop and the present loop, which is determined based on output from the air-conditioner switch sensor 22 (steps 207 and 208), and whether or not there has been a change from ON to OFF or OFF to ON of the brake between the immediately preceding loop and the present loop, which is determined based on output from the brake switch sensor 23 (steps 209 and 210).

If any of the answers to the questions of the steps 201 to 205 is negative (No) or any of the answers to the questions of the steps 206 to 210 is affirmative (Yes), it is determined that the vehicle is not in the cruising condition (i.e. the answer to the question of the step 112 is negative), whereas if all the answers to the questions of the steps 201 to 205 are affirmative (Yes), and at the same time all the answers to the questions of the steps 206 to 210 are negative (No), it is determined that the vehicle is in the cruising condition (i.e. the answer to the question of the step 112 is affirmative).

Referring back to the step 112, if the answer to the question of this step is negative (No), it is determined at a step 113 whether or not the flag $F_{-PGS}$ is equal to 1. If the answer to this question is negative (No), i.e. if the vehicle is not in the cruising condition and at the same time purging should not be carried out, the following steps 114 to 116 are carried out to provide for execution of steps 117 to 127, referred to hereinafter, to be executed after the engine enters the cruising condition.

More specifically, an average value $K_{O2VPF}$ of the correction coefficient $K_{O2}$ during cruising before the start of purging is initialized to 1.0 (step 114), the $t_{KO2AVECKF}$ timer is set to the predetermined value $t_{KO2AVECKF}$ (step 115), and a $t_{VPCK}$ timer formed of a down counter, which measures time elapsed after the start of purging, is set to a predetermined value $t_{VPCK}$ (e.g. 5 seconds) (step 116), followed by the program proceeding to the step 107.

On the other hand, if the answer to the question of the step 113 is affirmative (Yes), the program skips over the steps 114 to 116 to the step 107.

If the answer to the question of the step 112 is affirmative (Yes), it is determined at a step 117 whether or not the count value of the $t_{KO2AVECKF}$ timer is equal to 0. If the answer to this question is negative (No), i.e. if the predetermined time period $t_{KO2AVECKF}$ has not elapsed yet after the vehicle entered the cruising condition, the output value $V_{O2}$ of the $O_2$ sensor 16 is compared with a predetermined reference value and it is determined at a step 118 whether or not the result of the comparison has been inverted between the immediately preceding loop and the present loop.

If the answer to the question of the step 118 is affirmative (Yes), the average value $K_{O2VPF}$ of the correction coefficient $K_{O2}$ during cruising before the start of purging is calculated based on the following equation (2):

$$K_{O2VPF} = K_{O2} \times (C_{O2VPF}/256) + K_{O2VPF} \times [(256 - C_{O2VPF})/256] \quad (2)$$

where $K_{O2}$ represents a present value of the air-fuel ratio feedback correction coefficient $K_{O2}$ calculated based on the output value of the $O_2$ sensor 16 by a different routine executed whenever a TDC signal pulse is supplied to the ECU 5, $C_{O2VPF}$ a value selected from a range of 1 to 256, and $K_{O2VPF}$ on the right side a value of the average value $K_{O2VPF}$ obtained up to the immediately preceding loop, the initial value thereof being set to 1.0 at the step 114.

If the answer to the question of the step 118 is negative (No), the program skips over the step 119 to a step 120, where the $t_{VPCK}$ timer is set to the predetermined time period $t_{VPCK}$, followed by the program proceeding to the step 107.

If the answer to the question of the step 117 is affirmative (Yes), i.e. if the predetermined time period $t_{KO2AVECKF}$ has elapsed after the vehicle entered the cruising condition, the flag $F_{-PGS}$ is set to 1 at a step 121 to indicate that purging should be carried out. Then at a step 122, a reference value $K_{O2CHK}$ is obtained by subtracting a correction value $\Delta K_{O2VP}$ (e.g. 20% of the average value $K_{O2VPF}$) from the average value $K_{O2VPF}$ calculated at the step 119. The correction value $\Delta K_{O2VPF}$ preferably corresponds to an amount of evaporative fuel to be purged into the intake pipe 2 in this engine operating condition (i.e. the condition obtained when the answer to the question of the step 117 is affirmative (Yes)), if the evaporative fuel-purging system is normally functioning. At the following step 123, it is determined whether or not a present value of the correction coefficient $K_{O2}$ is larger than the thus obtained reference value $K_{O2CHK}$.

If the answer to the question of the step 123 is negative (No), i.e. if the present value of the correction coefficient $K_{O2}$ is not larger than the reference value $K_{O2CHK}$, it is judged that there is no such failure as to cause a decrease in the amount of evaporative fuel which is purged from the fuel tank 7 through the canister 18 into the intake pipe, i.e. such failure as to prevent the air-fuel ratio feedback correction coefficient $K_{O2}$ from decreasing by an amount of $\Delta K_{O2VP}$ or more (a decrease in the $K_{O2}$ value by the amount of $\Delta K_{O2VP}$ or more should accompany purging if the evaporative fuel-purging system is normally functioning), the system check-over flag $F_{-CK}$ is set to 1 at step 124 to indicate that the checking of the system abnormality has been finished, and the program proceeds to the steps 107 and 109 to carry out purging.

If the answer to the question of the step 123 is affirmative (Yes), it is determined at a step 125 whether or not the count value of the $t_{VPCK}$ timer is equal to 0. If the answer to this question is negative (No), the program proceeds to the steps 107 and 109 without setting the flag $F_{-CK}$ to 1. Therefore, in the following loops, the answer to the question of the step 110 is negative (No), so that the determinations at the steps 123 and 125 are carried out. As a result, if the state of the correction coefficient $K_{O2}$ being larger than the reference value $K_{O2CHK}$ (the answer to the question of the step 123 being affirmative) has continued over the predetermined time period $t_{VPCK}$ after the start of purging, it is judged that there is such failure as mentioned above in the evaporative fuel-purging system, so that a flag $F_{-EVPNG}$ is set to 1 at a step 126 to indicate the occurrence of failure, and the system check-over flag $F_{-CK}$ is set to 1 at a step 127, followed by the program proceeding to the steps 107 and 109. If the flag $F_{-EVPNG}$ is set to 1, a predetermined fail-safe operation is carried out on the evaporative fuel-purging system and the driver is warned of the failure, by a different routine.

If the answer to the question of the step 111 is affirmative (Yes), i.e. if the predetermined time period $t_{TWPGS}$ has elapsed after the engine coolant temperature $T_W$ became higher than the predetermined value $T_{WPGS}$, since there is a possibility that the amount of evaporative fuel generated may exceed the capacity of the canister 18, it is judged that purging should be carried out immediately, so that the flag $F_{-PGS}$ is set to 1 at a step 128, and the program proceeds through the steps 113 and 107 to the step 109.

Figure 5:
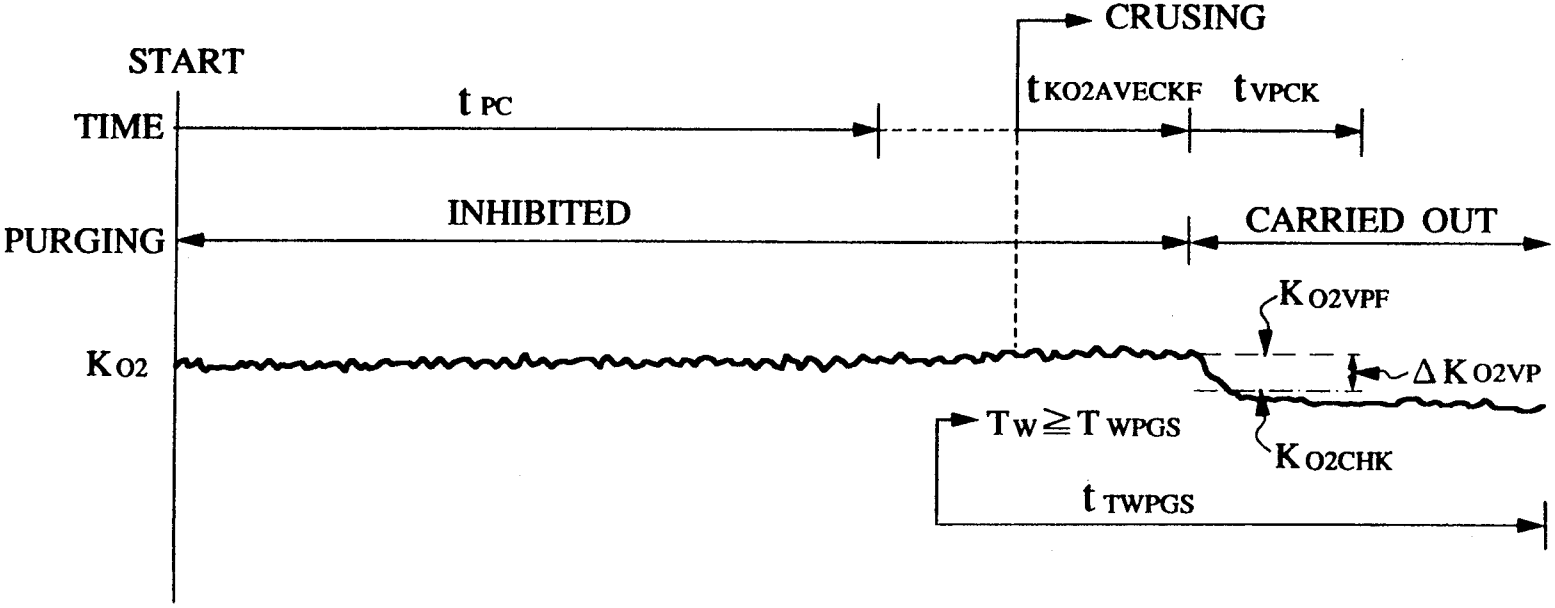
FIG. 5 is a timing chart showing timing of stoppage of purging, execution of purging, and determination of failure in the evaporative fuel-purging system by the use of a correction coefficient $K_{O2}$.

FIG. 5 shows timing of inhibition and execution of purging and determination of failure in the system by the correction coefficient $K_{O2}$, which are carried out according to the program shown in FIG. 2. Specifically, after the predetermined time period $t_{PC}$ has elapsed after the start of the engine, determinations are carried out as to the cruising condition of the vehicle and the engine coolant temperature $T_W$. Inhibition of purging (purge cut) is carried out over the predetermined time period $t_{KO2AVECKF}$ from the time the vehicle enters the cruising condition after the start of the engine. Purging is carried out only after the lapse of the predetermined time period $t_{KO2AVECKF}$.

Based on values of the correction coefficient $K_{O2}$ obtained during the predetermined time period $t_{KO2AVECKF}$ (a second predetermined time period), the average value $K_{O2VPF}$ (a first value) is obtained. When the state in which a value of the correction coefficient $K_{O2}$ obtained during execution of purging is larger than the reference value $K_{O2CHK}$ obtained based on the average value $K_{O2VPF}$ continues over the predetermined time period $t_{VPCK}$ (a first predetermined time period), it is judged that there is failure in the evaporative fuel-purging system. In other words, if purging is carried out by the evaporative fuel-purging system which is normally functioning, the air-fuel mixture is enriched. The enriched air-fuel ratio of the mixture is detected by the $O_2$ sensor 16, and a signal indicative of the enriched air-fuel ratio is supplied to the ECU in the feedback manner, which should normally result in a decrease in the value of the correction coefficient $K_{O2}$. Therefore, by monitoring the degree of the decrease in $K_{O2}$, it is determined whether or not there is failure in the evaporative fuel-purging system.

After the predetermined time period $t_{TWPGS}$ (a third predetermined time period) has elapsed after the engine coolant temperature $T_W$ became equal to or higher than the predetermined value $T_{WPGS}$, purging is forcedly carried out even when purging was not carried out because the vehicle did not enter the cruising condition, to thereby effect protection of the canister 18.

FIG. 6 shows an evaporative fuel-purging system of an internal combustion engine to which is applied a failure-detecting method according to a second embodiment of the invention. The evaporator fuel-purging system is similar in construction to the one in FIG. 1, but different only in that an inflammable gas sensor 25 is arranged across the purging passage 24 for detecting the concentration of evaporative fuel to thereby supply an output signal from the sensor 25 to the ECU 5.

The inflammable gas sensor 25 has an element comprising a core formed of a platinum coil around which sintered porous alumina carrying a precious metal catalyst is mounted. Voltage is applied to a bridge circuit incorporating the element to heat the element to a predetermined operating temperature by Joule heat generated by the platinum coil. Inflammable gas in contact with the element is oxidized on the surface thereof by catalytic action. Heat of reaction generated by the oxidation increases the temperature of the element to thereby increase the electric resistance of the platinum coil. This causes the output voltage of the bridge circuit to increase, which is supplied as an output signal from the sensor 25. FIG. 8 shows an output characteristic of the sensor 25 that the output from the sensor varies in proportion to the concentration of gasoline.

The method of detecting failure in the evaporative fuel-purging system according to the second embodiment of the invention will be described with reference to a program shown in FIG. 7.

The failure-detecting method according to the second embodiment is different from that according to the first embodiment in that a difference in concentration of evaporative fuel supplied to the intake pipe between inhibition of purging and execution of purging is directly detected by the output from the inflammable gas sensor 25.

In the program of FIG. 7, first at a step 301, it is determined whether or not the engine is in the starting mode. If the engine is in the starting mode, the $t_{PC}$ timer is set to the predetermined time period $t_{PC}$ read from the table in accordance with the engine coolant temperature (step 302). After completion of the starting mode of the engine, the $t_{PC}$ timer starts measuring time elapsed thereafter, and when the count value of the $t_{PC}$ timer is equal to 0 at a step 303, it is determined at a step 304 whether or not the number nT of trips made after replacement of a canister (one trip corresponds to time between turning-on of the ignition switch and turning-off of same) is equal to or more than a predetermined value nTS (e.g. 5). If $nT \geqq nTS$, it is determined at a step 305 whether or not the engine coolant temperature $T_W$ is lower than the predetermined value $T_{WPGS}$ (e.g. 50° C.). If $T_W \geqq T_{WPGS}$, it is determined at a step 306 whether or not the system check-over flag $F_{-CK}$ is equal to 1. In the first loop, $F_{-CK}=0$, and accordingly the program proceeds to a step 326, where it is determined whether or not the count value of the $t_{TWPGS}$ timer reset at a step 327 referred to hereinafter is equal to 0. If the answer to this question is negative (No), the program proceeds to a step 307, where it is determined whether or not the vehicle is in the cruising condition, in a manner similar to the step 112 of FIG. 2 (i.e. SUB 1 of FIG. 4) described hereinabove. If the vehicle is in the cruising condition, a $t_{VHC1}$ timer starts measuring time elapsed after the vehicle entered the cruising condition, and it is determined at a step 308 whether or not the predetermined time period $t_{VHC1}$ (e.g. 5 seconds) has elapsed and hence the count value of the $t_{VHC1}$ timer is equal to 0. Until $t_{VHC1}=0$, values of output $V_{HC}$ from the inflammable gas sensor 25 are read to calculate an average value $V_{HC1}$ thereof at a step 309. Then the $t_{VPCK}$ timer, which measures time elapsed after the start of purging, is reset at a step 310, and it is determined at a step 311 whether or not the flag $F_{-PGS}$ is equal to 1. In the first loop, $F_{-PGS}=0$, and accordingly, the solenoid 19a of the purge control valve 19 is energized to stop purging. If the vehicle ceases to be in the cruising condition before $t_{VHC1}=0$, the program proceeds from the step 307 to a step 314, where it is determined whether or not $F_{-PGS}=0$. Since in this case the answer to this question is negative (No), the $t_{VHC1}$ and $t_{VPCK}$ timers are reset at respective steps 315 and 316. Thus, the value $V_{HC1}$ calculated at the step 309 is decided to be used as an average value of values of the output from the sensor 25 obtained while the vehicle continues to be in the cruising condition over the predetermined time period measured by the $t_{VHC1}$ timer. During the time period, purging is inhibited.

If $t_{VHC1}=0$, the flag $F_{-PGS}$ is set to 1 at a step 317, and when the program proceeds to the step 311 thereafter, it is determined that the answer to the question of this step is affirmative (Yes), so that energization of the solenoid 19a is stopped to carry out purging (step 313). Further, in the course of the program proceeding from the step 317 to the step 311, a reference value $V_{HC2}$ is calculated by adding a predetermined value $\Delta V_{HC}$ to the aforementioned average value $V_{HC1}$ at a step 318. The predetermined value $\Delta V_{HC}$ corresponds to an amount of evaporative fuel to be purged into the intake pipe 2 in the present engine operating condition (i.e. the condition obtained when the answer to the question of the step 307 is affirmative (Yes)), if the evaporative fuel-purging system is normally functioning. And then it is determined at a step 319 whether or not a present value of the output $V_{HC}$ from the inflammable gas sensor 25 is higher than the reference value $V_{HC2}$. When $V_{HC}>V_{HC2}$, the flag $F_{-CK}$ is set to 1 at a step 320, followed by the program proceeding to the step 311. When $V_{HC}\leqq V_{HC2}$, it is determined at a step 321 whether or not the $t_{VPCK}$ timer has finished counting the predetermined time period $t_{VPCK}$. If the answer is affirmative (Yes), that is, if $V_{HC}>V_{HC2}$ does not hold even after the time period $t_{VPCK}$ has elapsed, the program proceeds to a step 322, where the flag $F_{EVPNG}$ is set to 1 to indicate occurrence of failure in the evaporative fuel-purging system. Then, at a step 323, the flag $F_{-CK}$ is set to 1, followed by the program proceeding to the step 311.

In the meanwhile, before the count value of the $t_{PC}$ timer becomes equal to 0 after the start of the engine, the program proceeds from the step 303 to the step 312 through the steps 314, 315, 316, and 311, in the order mentioned. Further, when $nT<nTS$, the program proceeds from the step 304 to a step 324, where the flag $F_{-PGS}$ is set to 1, and thereafter the program proceeds via the steps 314 and 311 to the step 313. In the following loops, this determination process is repeatedly carried out without carrying out determination of failure in the evaporative fuel-purging system. This is intended to avoid an erroneous detection of failure in the case where a sufficient amount of evaporative fuel is not adsorbed yet in a new canister after replacement thereof. In this connection, replacement of the canister is carried out after removing the battery from the engine for safety purposes. Therefore, a removal operation of the battery is regarded as a replacement operation of the canister, and the determination at the step 304 is effected based on the number nT of trips made after any removal operation of the canister.

If $T_W<T_{WPGS}$ at the step 305, the program proceeds to a step 327, where the $t_{TWPGS}$ timer is reset, and then to a step 325, where the $t_{VHC1}$ timer is reset to provide for time-measuring carried out by the $t_{VHC1}$ timer at the step 308.

Further, when the failure determination is carried out at the steps 319 and 321, and the flag $F_{-CK}$ is set to 1 at the step 320 or 323, the program proceeds in the following loops from the step 306 through the steps 325 and 311 to the step 313 to thereby continue purging.

Further, if the answer to the question of the step 326 is affirmative (Yes), i.e. if the count value of the $t_{TWPGS}$ timer is equal to 0, the program proceeds to the step 324 to carry out purging.

In order to improve accuracy in failure-detection, it is preferable to provide the step 307 for determining whether the vehicle is in the cruising condition. However, in principle, the step 307 may be omitted. However, if the step 307 is omitted, in order to ensure that the determination at the step 319 is carried out based on the sensor output $V_{HC}$ obtained when a sufficient level of negative pressure required for purging is applied to the purging passage 24, i.e. when the throttle valve opening $\theta_{TH}$ is equal to or larger than a predetermined value $\theta_{VPCK}$ (e.g. 4°), it is preferable to provide a step for determining whether or not the throttle valve opening $\theta_{TH}$ is equal to or larger than the predetermined value $\theta_{VPCK}$, between the step 306 and the step 308, as shown in FIG. 9.

What is claimed is:

1. In a method of detecting abnormality in an evaporative fuel-purging system for an internal combustion engine having a fuel tank, and an intake passage, said evaporative fuel-purging system having a canister for adsorbing evaporative fuel from said fuel tank, and a purging passage through which said evaporative fuel is purged from said canister into said intake passage, said engine having a sensor for detecting a parameter reflecting an amount of said evaporative fuel purged into said intake passage, the improvement comprising the steps of:

(1) determining whether or not said engine is in a predetermined operating condition after completion of warming-up of said engine;

(2) temporarily inhibiting said purging of said evaporative fuel into said intake passage when it is determined that said engine is in said predetermined operating condition;

(3) obtaining a first value based on said parameter during said temporary inhibition of said purging of said evaporative fuel;

(4) obtaining a second value based on said parameter during execution of said purging of said evaporative fuel carried out after said temporary inhibition of said purging of said evaporative fuel;

(5) comparing said first value with said second value; and (6) determining whether or not there is abnormality in said evaporative fuel-purging system, based on a result of said comparison.

2. A method according to claim 1, wherein said engine has an exhaust passage, said sensor being an air-fuel ratio sensor arranged in said exhaust passage for detecting an air-fuel ratio of a mixture supplied to said engine as said parameter, said first and second values being values of an air-fuel ratio correction coefficient determined based on said detected air-fuel ratio for controlling an amount of fuel supplied to said engine.

3. A method according to claim 2, wherein said step (6) comprises determining that there is abnormality in said evaporative fuel-purging system when said second value of said air-fuel ratio correction coefficient is larger than a predetermined reference value obtained by subtracting a correction value corresponding to an amount of said evaporative fuel to be purged into said intake passage from said first value of said air-fuel ratio correction coefficient.

4. A method according to claim 3, wherein it is determined that there is abnormality in said evaporative fuel-purging system when said second value has continually been larger than said predetermined reference value over a first predetermined time period.

5. A method according to claim 2, wherein said predetermined operating condition is a condition in which a temperature of said engine is not lower than a predetermined value, and at the same time a vehicle on which said engine is installed is cruising.

6. A method according to claim 5, wherein said first value of said air-fuel ratio correction coefficient is calculated by averaging values of said air-fuel ratio correction coefficient obtained when said engine is in said predetermined operating condition, over a second predetermined time period.

7. A method according to claim 5 or 6, wherein said inhibition of said purging of said evaporative fuel into said intake passage is continued until calculation of said first value of said air-fuel ratio correction coefficient is completed after the start of said engine carried out when said temperature of said engine is lower than said predetermined value.

8. A method according to claim 2, wherein said purging of said evaporative fuel into said intake passage is carried out irrespective of operating conditions of said engine, when a third predetermined time period has elapsed after completion of said warming-up of said engine.

9. A method according to claim 1, wherein said sensor is an inflammable gas sensor arranged in said purging passage for detecting concentration of said evaporative fuel as said parameter, said first and second values based on said parameter being values of output from said inflammable gas sensor.

10. A method according to claim 9, wherein said step (6) comprises determining that there is abnormality in said evaporative fuel-purging system when said second value of said output from said inflammable gas sensor is not larger than a predetermined reference value obtained by adding a correction value corresponding to an amount of said evaporative fuel to be purged into said intake passage to said first value of said output from said inflammable gas sensor.

11. A method according to claim 10, wherein it is determined that there is abnormality in said evaporative fuel-purging system when said second value has continually been not larger than said predetermined reference value over a first predetermined time period.

12. A method according to claim 9, wherein said predetermined operating condition is a condition in which a temperature of said engine is not lower than a predetermined value, and at the same time a vehicle on which said said engine is installed is cruising.

13. A method according to claim 12, wherein said first value of said output from said inflammable gas sensor is calculated by averaging values of said output from said inflammable gas sensor obtained when said engine is in said predetermined operating condition, over a second predetermined time period.

14. A method according to claim 12 or 13, wherein said inhibition of said purging of said evaporative fuel into said intake passage is continued until calculation of said first value of said output from said inflammable gas sensor is completed after the start of said engine carried out when said temperature of said engine is lower than said predetermined value.

15. A method according to claim 9, wherein said purging of said evaporative fuel into said intake passage is carried out irrespective of operating conditions of said engine, when a third predetermined time period has elapsed after completion of said warming-up of said engine.

16. A method according to claim 9, wherein said engine has a throttle valve arranged in said inatke passage, and said predetermined operating condition is a condition in which a temperature of said engine is not lower than a predetermined value, and at the same time the opening of said throttle valve is not smaller than a predetermined value.

* * * * *